United States Patent [19]

Torbet

[11] Patent Number: 4,662,012

[45] Date of Patent: May 5, 1987

[54] BED UTILIZING AN AIR MATTRESS

[76] Inventor: Philip A. Torbet, 41 Sandy Hollow Rd., Port Washington, N.Y. 11050

[21] Appl. No.: 559,034

[22] Filed: Dec. 7, 1983

[51] Int. Cl.[4] ..... A47C 27/08; A47C 27/10

[52] U.S. Cl. ..... 5/453; 5/455

[58] Field of Search ..... 5/449, 453–458

[56] References Cited

U.S. PATENT DOCUMENTS

| | | | |
|---|---|---|---|
| 2,245,909 | 6/1941 | Enfiajian | 5/455 |
| 2,575,764 | 11/1951 | Morner | 5/457 |
| 2,731,652 | 1/1956 | Bishop | 5/455 |
| 3,468,311 | 9/1969 | Gallagher | 5/458 |
| 3,583,008 | 6/1971 | Edwards | 5/455 |
| 3,879,776 | 4/1975 | Soden | 5/453 |
| 4,279,044 | 7/1981 | Douglas | 5/453 |
| 4,422,194 | 12/1983 | Viesturs et al. | 5/455 |
| 4,488,322 | 12/1984 | Hunt et al. | 5/453 |

*Primary Examiner*—Alexander Grosz
*Assistant Examiner*—Michael F. Trettel
*Attorney, Agent, or Firm*—Wood, Herron & Evans

[57] ABSTRACT

A bed wherein a spring foundation supports an air mattress. The air mattress is formed from two air-impermeable sheets, each sheet having been vacuum-formed to provide a plurality of aligned recesses. The sheets are sealed face-to-face so that the aligned recesses form a plurality of cells that are inflated, approximately 20 rows of cells extending the length of the mattress.

17 Claims, 5 Drawing Figures

BED UTILIZING AN AIR MATTRESS

This invention relates to an air mattress and, particularly, the invention relates to an air mattress suitable for home use to improve significantly the quality of sleep of the user. Good sleeping is normally associated with minimum body shifts. Most people experience about forty major postural shifts in the course of a night's sleep. Poor sleepers experience about sixty percent more movement than good sleepers.

Two major causes of shifting and, hence, poor sleep are the buildup of pressures on prominences of the body and poor postural support, which stresses muscles, tendons and ligaments. As to the first, everyone has experienced discomfort on parts of the body from prolonged sitting or lying in the same position. Because of the surfaces engaged by the body and the body's prominences, tissues of the body are put in high compression in such a way as to restrict capillary blood flow. The pressure which causes a discontinuance of capillary blood flow is called ischemic pressure. Thirty mmHg is normally considered to be the ischemic threshold. Most people are familiar with this phenomenon when a red spot appears after prolonged pressure, indicating approaching tissue damage. Those parts of the body which are subjected to pressures above the ischemic threshold will cause discomfort and, hence, will cause the person to shift his body to rid the distress.

With regard to postural support, many persons are familiar with pain in the lumbar region of the back when that region has been unduly stressed. Most sleep surfaces allow hammocking, or sagging, of the body to certain degrees, thereby inducing a lateral bending of the vertebral column while in a side-sleeping position. This occurs regardless of the hardness or the softness of the mattress, but is more pronounced on a soft mattress. Any mattress will allow the waist to drop so as to become aligned with the rib cage and hip contact points. This sagging causes ligamentous and muscular strain, which will be perceived by the sleeper and cause a postural shift in order to relieve the strain.

As suggested above, the strains and ischemic pressures occur on conventional mattresses, regardless of the hardness or softness of the mattress. Conventional mattresses include feather beds, innerspring mattresses, orthopedic mattresses, waterbeds and the like.

There are in the prior art disclosures of air mattresses attempting to eliminate ischemic pressures and to provide uniform support of the body. Examples of these are U.S. Pat. Nos. 3,605,145 and 4,005,236, as well as a British patent, No. 1,545,806. The structures of these patents are unnecessarily complex and, in the final analysis do not provide a desired support, particularly bodily alignment support, as does the present invention as will appear below.

SUMMARY OF THE INVENTION

An objective of the present invention has been to provide an air mattress which provides substantially uniform support of all portions of the body as well as spinal alignment of the body, whether in side-laying or back-laying position.

This objective of the invention is attained by providing a pair of air-impermeable sheets, each being vacuum-formed to provide a plurality of rows and columns of recesses or pockets. The two sheets, when placed together on a central plane, have their recesses aligned and projecting to each side of the plane so as to form cells which are generally oblong and semispherical at the ends. The sheets are sealed around the perimeter of the sheets and the cells are sealed all the way around their perimeters, except for about a ½" gap between each cell which permits communication among the cells. Preferably, each cell is about 7" deep. Each cell in plan view is a hexagon. The dimension of the hexagon from apex to apex is slightly in excess of 5". The seals between adjacent cells are ⅛" wide so that the cells are substantially contiguous to one another. The cells are spaced as closely as possible to one another, so as to provide a minimum of air space or void between cells, and as to provide a most complete support of the entire body area of a person reclining atop the mattress.

While the cells could be square in cross section, square cells are more difficult than hexagonal cells to vaccum form. The hexagonal configuration provides cells which, when inflated, are generally semispherical on the ends and oblong in the vertical depth dimension.

The material from which the mattresses are formed is a 34 mil polyvinylchloride. In the forming of the pvc films, occasional pinholes develop during a calendaring operation. It is therefore preferred to laminate two thin films in order to form the 34 mil sheets. The pinholes occur infrequently enough that the chance of pinholes aligning after the sheets are laminated is negligible.

The sheets are placed on a vacuum-forming tool consisting of a plurality of pockets formed by ⅛" dividers, the pockets being about 4½" deep. When the heated sheet is vacuum-drawn into the pockets, the film stretches to about a 6 mil thickness at the bottom of each pocket and a pocket depth, when cooled, of approximately 3½". It has been found that by providing a mandrel at each pocket to assist the stretching of the film, a more uniform thickness of film can be imparted to each pocket. Use of the assist will result in an increase of film thickness significantly above 6 mils at the bottom of each pocket.

The mattress is divided into zones, preferably four, by sealing completely between transverse rows. For example, a preferred form of the invention utilizes 20 rows of cells, each row having approximately 8 cells of equal volume. The first 7 rows of cells provide head and trunk support, including the shoulder of the sleeper, and is inflated to 10 mmHg.

The 8th and 9th rows form another zone for the waist of the sleeper and is inflated for 22 mmHg. That substantially higher inflation supports the waist against sagging in the side-lying position and maintains the desired straight spinal alignment.

The third zone is formed of rows 10 through 12 and supports the hip at a pressure of 12 mmHg. The remaining rows, 13 through 20, support the legs and feet and are inflated to 5 mmHg.

These pressures are all subischemic, that is, below 30 mmHg and preferably range between 5 and 22 mmHg. The depth of the cells is great enough, approximately 7", that the sleeper, in a fully reclined position, does not bottom out. No body prominence is subjected to more than about 22 mmHg, and hence no discomfort from blocking capillary flow will occur.

Four pumps of the vibrating diaphragm type are selectively connected, one to each zone, and pressure relief valves are provided to maintain the desired pressures in the respective zones, either by bleeding off air or by introducing air through the pumps, regardless of the weight of the sleeper. The pumps and the pressure relief valves are preferably connected to one side of the mattress. Pressure sensors are connected to the other side of the mattress, the pressure sensors being connected respectively to the pumps and relief valves so as to operate them in order to maintain the pressure at the desired levels. It is preferred to have the pressure sensors on the opposite side of the mattress from the pump inlets because the transmission of air through the ½ inch gaps between cells is rather slow. If the sensors were on the same or inlet side as the pump, they would react too quickly to shut off the pumps in response to inflation of the cells on the inlet side and instant feedback of a pressure signal from the inlet side of the mattress to the sensors before the cells on the remote side began to increase in pressure. When the air subsequently flowed from the pump inlet side of the mattress toward the remote side, the pressure on the inlet side would decrease and the pump would be turned back on only to be instantly turned off as the pressure increased on the inlet side, thereby resulting in the pump chattering until the desired pressure level was achieved. Location of the sensors on the opposite side of the mattress from the pump inlets eliminates this pump chattering problem.

In practice, air is introduced in order to inflate the mattress to a level at which it has a normal, generally rectangular, flat top surface appearance. When the sleeper lies upon the mattress, however, the pressure of the sleeper's body on the mattress significantly reduces the volume of the mattress and, hence, the pressure becomes too high. The air is thereby exhausted until the desired pressure described above are again reached.

The gaps between the cells, which permit air communication among the cells, are rather precisely sized. If the gap is too small, the air moves too slowly from cell to cell and the sleeper making a postural shift has the feeling that he is shifting against excessive resistance or attempting to roll uphill. On the other hand, if the gap is too large, the air moves too quickly from cell to cell and the sleeper in shifting has the feeling of loss of support at the sides, with a resulting downhill rolling sensation. With the preferred thickness of material, a 34 mil polyvinychloride, the gap size is preferably about ½". It has been found that a ¼" gap gives the feeling of rolling uphill, and the ¾" gap gives the feeling of rolling downhill during a postural shift.

The mattress preferably is supported on a box spring foundation. Under static conditions the difference between a spring foundation and a board foundation is not discernible. However, under dynamic conditions the spring foundation creates a bed which feels more alive. Further, when the occupant sits up, the cells immediately under the posterior may collapse, and the posterior resting on a spring foundation will be more comfortable.

The several features and objectives of the invention will become more readily apparent from the following detailed description, taken in conjunction with the accompanying drawings, in which.

The mattress indicated at 25 is formed from two sheets of 34 mil (0.034") vinyl. Each vinyl sheet is formed of two films which are laminated together, thus eliminating pinhole leaks. Each sheet has been heated and vacuum-formed to provide a series of recesses or pockets 28. The two sheets overlie each other with the pockets facing each other. The sheets are sealed around edges 30 and 31 to enclose the pockets.

Figure 3:
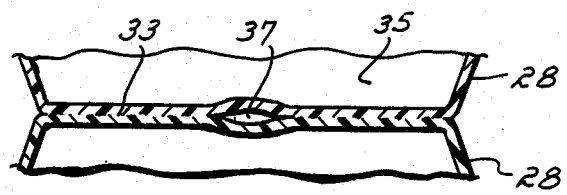
FIG. 3 is a cross-sectional view taken along lines 3—3 of FIG. 1.

For the most part, the pockets are hexagonal with seals 33 being formed between adjacent pockets in order to form cells 35. As best shown in FIG. 3, the seals between adjoining cells are not completely formed within any zone. Rather, a gap of about one-half inch in length is provided in each seal, the gap being indicated at 37 in FIG. 3. The gap between each cell within any zone permits a uniform distribution of air among all of the cells of the zone and permits a shifting of air from cell to cell as the sleeper shifts his position on the mattress.

Each pocket 28 is about 3½" deep so that each cell is about 7" in height. Each hexagon is about 4½" from flat to flat and 5.2" from peak to peak. The hexagonal cells are preferred in that the cells, when inflated, approximate oblong cylinders having semispherical ends. The hexagonal cross-sectional configurations permit the cells geometrically to nest snugly against one another, thereby providing a substantially contiguous surface with minimum air gaps beneath the sleeper.

The mattress rests on a foundation 38 to form the bed. The foundation preferably is a box spring, but other foundations will suffice.

The mattress is divided into four zones. Zone 1, formed by rows 1–7 and indicated at 41, is an upper body zone and extends to about the end of the rig cage of the sleeper. Zone 2, formed by rows 8 and 9 and indicated at 42, is a waist zone which underlies only the waist area of the sleeper. Zone 3, formed by rows 10–12 and indicated at 43, is a pelvic zone which receives the hips of the sleeper to include and support the pelvic area. Zone 4, formed by rows 13 through 20 and indicated at 44, is a leg zone which receives the legs and feet of the sleeper. Three continuous transverse seals 45 close the gaps between adjoining cells and thus divide the mattress into the four zones.

Each zone has an air connection indicated at 50 to two pressure-sensitive switches 51, 52. The switches are connected to a power supply 53 on one side. Switch 51 is connected to a vibrating diaphragm pump 54 of the type commonly used to aerate an aquarium. Switch 52 is connected to a solenoid 55 (only one pair of switches 51, 52 for zone 4 is illustrated).

On the other side of the mattress, each zone has a line 60, 61, 62, 63. Each line is connected through a respective solenoid valve 55 to its respective pump 54, one pump and one solenoid valve being provided for each zone (only one pump and one solenoid valve for line 60, zone 4, is illustrated). When the pressure in a zone is too high, switch 52 will close to operate the solenoid which permits air to bleed past the valve seat 56 to atmosphere. When air pressure is too low, switch 51 will close to cause pump 54 to operate to introduce air into the respective zone. Each zone, the respective rows of cells comprising it, and the preferred air pressure in it are set forth below.

| Zone | Body Section | Rows | Millimeters |
|---|---|---|---|
| 1 | Upper body | 1–7 | 10 mmHg |

-continued

| Zone | Body Section | Rows | Millimeters |
|---|---|---|---|
| 2 | Waist | 8–9 | 22 mmHg |
| 3 | Pelvic | 10–12 | 12 mmHg |
| 4 | Legs | 13–20 | 5 mmHg |

By combining zones 1 and 4, a minimum of three different pressures can be employed in the four zones.

When the sleeper reclines on the mattress, the body weight will cause the air pressures to exceed those which are desired. The respective solenoids will operate to bleed air from the respective zones. Approximately twenty seconds is required to reduce the air pressures to the desired levels.

When the sleeper leaves the mattress, the air in the respective zones is below the desired level and the top surface of the mattress is not flat. In order to bring the mattress to a relatively flat, pleasing appearance, the respective pumps for each zone will pump air into the zones until the desired air pressures are once again attained.

Figure 1:
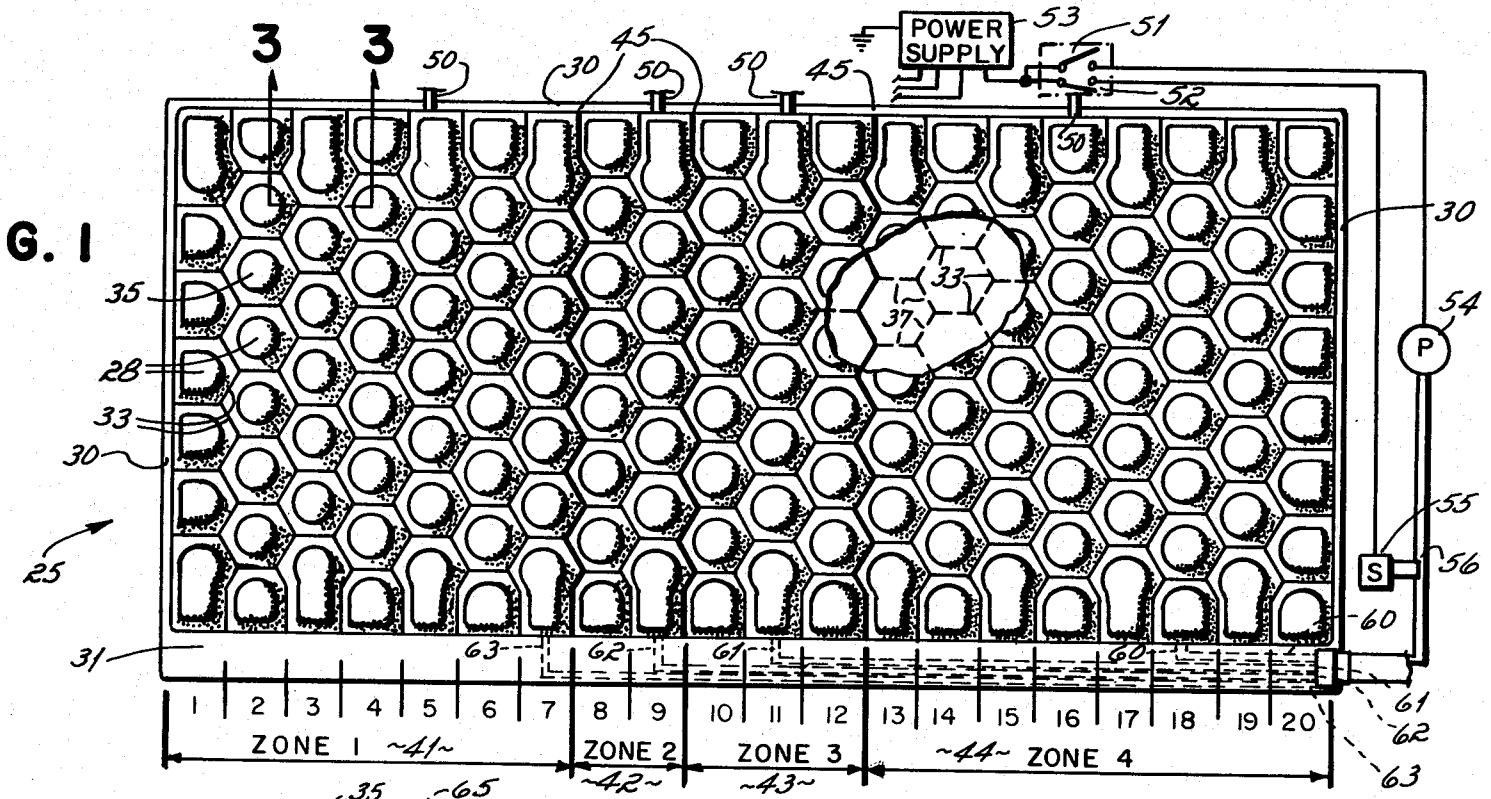
FIG. 1 is a plan view of a mattress in accordance with the present invention.
Figure 2:
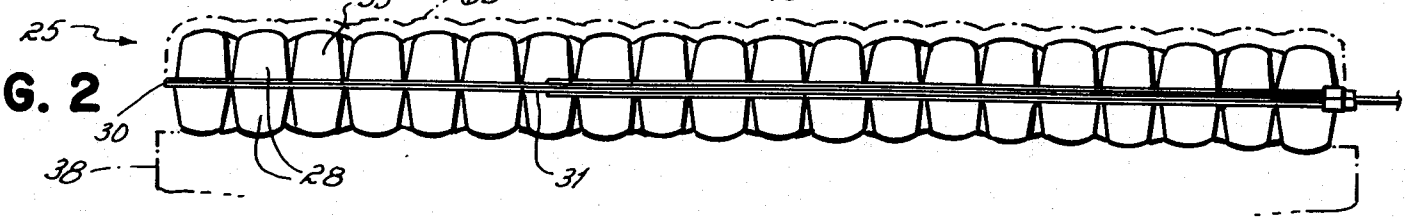
FIG. 2 is a side-elevational view of the mattress.

The mattress is covered with a non-woven quilted batting which in its uncompressed condition is about one inch thick. That material is indicated at 65 in FIG. 2. The preferred material is a 250% stretch fabric which allows shoulders and other body prominences to penetrate into the mattress and not be restrained by the material so as to have a minimal effect on surrounding areas.

Figure 4:
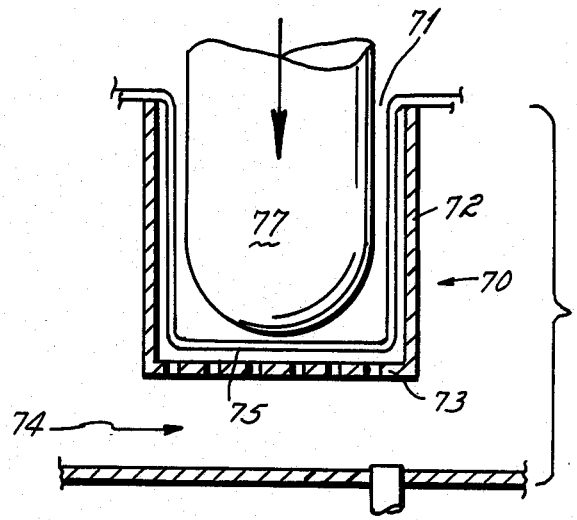
FIG. 4 is a diagrammatic cross-sectional view of a pocket of a forming tool with a mandrel assist.
Figure 5:
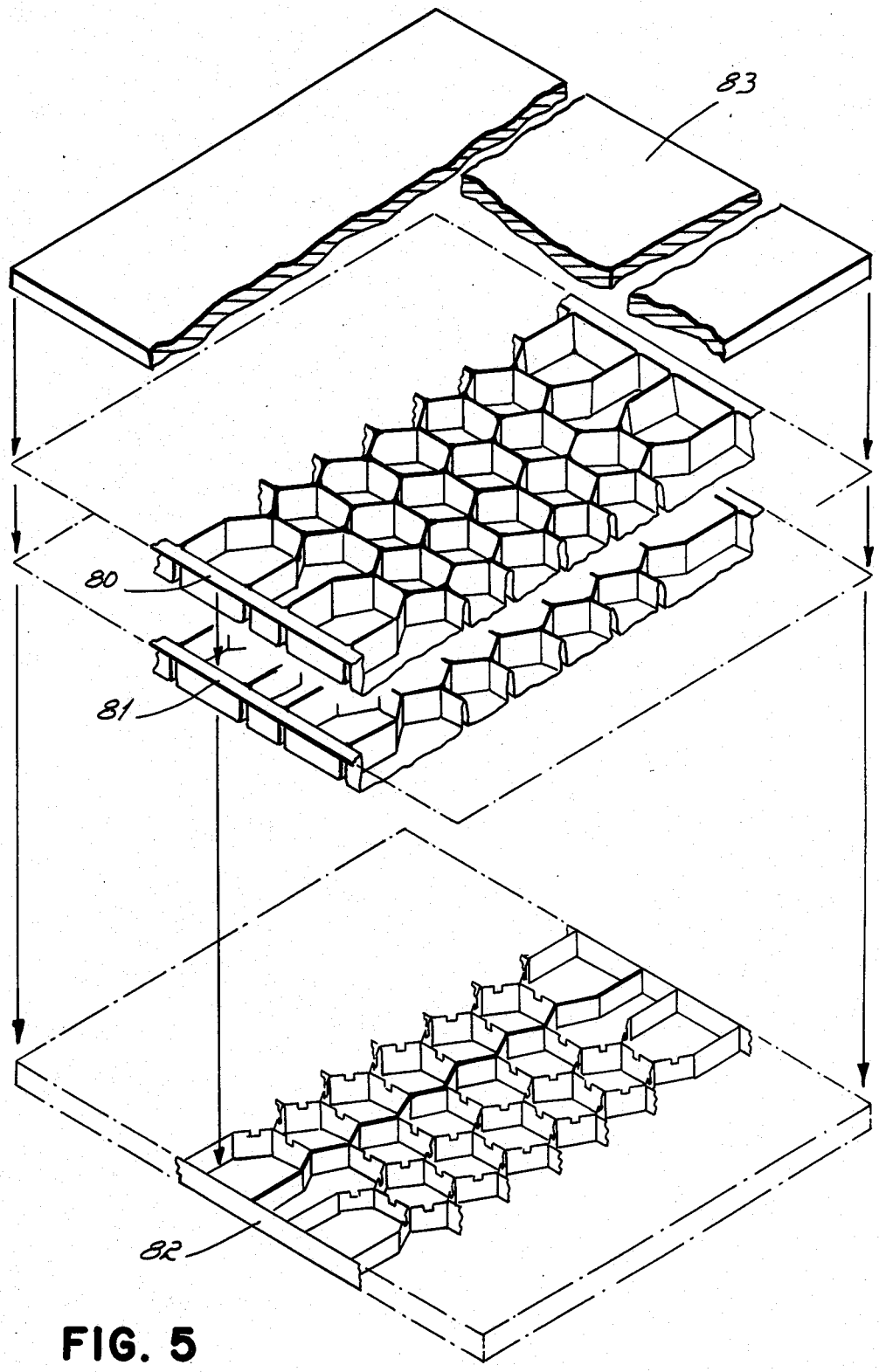
FIG. 5 is a diagrammatic view of the mattress and forming apparatus illustrating the method of forming the mattress.

The method of forming the mattress is illustrated in FIGS. 4 and 5. A tool, one pocket of which is indicated at 70, is formed with a plurality of hexagonal or partially hexagonal pockets, the pockets around the perimeter not being completely hexagonal. For the illustrated form of the invention, the tool will have 150 pockets 71 formed by the walls 72. The bottom wall 73 is foraminous as is conventional in vacuum-forming machinery. Each pocket is approximately 4½" deep and 5.2" from apex to apex of the hexagon. A vacuum manifold, indicated at 74, is located underneath the tool to apply the vacuum which draws the film into the pockets for the full 4½" depth.

In the forming of the pockets, the sheet is laid across the tool and is heated by conventional apparatus until it becomes formable. The vacuum is then applied to stretch the material and draw it into the pockets. The 34 mil vinyl sheets when thus formed will thin out to about 6 mils at the bottom of the pocket indicated at 75. It is therefore preferred to use an assisting mandrel 77, one for each pocket, which will engage the thermoplastic material and urge it downwardly while the vacuum is being applied. It has been found that the use of such a tool whose lateral dimensions bring it close to the walls of the pocket will tend to thin out the material in the pockets more uniformly. Thus, it is possible either to reduce the thickness of the starting material or, alternatively, using the same starting material to obtain a pocket thickness greater than the 6 mils.

FIG. 5 illustrates the manner in which the mattress is formed from two sheets which are vacuum-formed as described above. A first sheet 80 is nested into a second sheet 81. The two sheets are then nested into an electronic sealing die 82 whose upper edges define the hexagonal pattern where the seal is applied. The upper edge of the grill work has a thickness of 1/16". Each segment has a ½" notch where no seal will be formed in order to provide the air communication gap between cells within each zone. Means, not shown, are provided for electrically energizing the grill work. A flat platen 83 is brought down upon the nested vinyl sheets to press them against the grill work of the sealing die to dielectrically seal the mattress. The fixtures are preferably formed so that the tubing for the pressure switches and pump lines can be sealed into the mattress simultaneously with the dielectric sealing of the two sheets. While the sheets will be formed in a nesting relationship, when air is introduced into the mattress the inner pocket of the upper sheet 80 will pop out so that the mattress will attain the configuration of FIG. 2.

In the operation of the invention, the mattress positioned on the foundation 38 is inflated approximately to the pressures referred to above. The sleeper who may be from 100 to 250 pounds reclines on the mattress positioning his waist to overlie rows 8 and 9. It will be observed that the pressure in rows 8 and 9, which is zone 2, is significantly greater than the pressure in the other zones. This tends to maintain the waist in a relatively elevated position and contributes significantly to maintaining a good spinal alignment as well as total bodily alignment of the sleeper from head to toe. The pressures in the other zones are set in accordance with the average weights and body sizes so as to maintain the horizontal alignment when the sleeper is on his side.

As indicated above, the pressures in the respective zones are readjusted when the sleeper occupies the bed by bleeding off excess air from each of the affected zones.

When the sleeper is on his back or stomach, the pressures are readjusted to maintain the proper body alignment, taking into consideration the natural curvature of the spine.

As the sleeper rolls from one position on the bed to another, the air from the cells shifts to bleed air from the newly-occupied cells into the cells previously occupied. That bleeding of air takes place through gaps 37 between adjoining cells within a zone. That gap 37, which is approximately ½" long, provides a desirable rate of flow of air from cell to cell so that the sleeper neither feels as if he is rolling uphill nor rolling downhill as would be the case if the air bled too slowly or too rapidly.

When all of the conditions of air pressure and the like are met, the maximum pressure of any cell upon the body will be significantly lower than 30 mmHg. Since pressures below 30 mmHg are sub ischemic and, hence, do not collapse the blood cells engaged by the mattress, the sleeper is free from that pressure which would tend to wake the sleeper. Similarly, because the body is maintained in proper alignment, stress from muscles, tendons and ligaments are minimized. The substantial elimination of these stresses and high pressures occurring in conventional mattresses enables the sleeper to sleep comfortably with a minimum of shifts throughout the sleeping period.

While I have described only a single preferred embodiment of my invention, persons skilled in this art will appreciate numerous changes and modifications which may be made without departing from the spirit of my invention. For example, such persons will readily appreciate that if the mattress is to be utilized on a king or queen size bed, two mattresses 25, each having its own separate air inflation and deflation controls, would be employed in side-by-side relationship. Additionally, such persons will appreciate that rather than utilizing four separate pumps, one for each zone, a single pump may be utilized in combination with four solenoidoperated valves to control inflation of the four zones. Furthermore, while I have described a mattress which has four independently inflatable zones, persons skilled in the art will appreciate that the number of independently inflatable zones may be varied without departing from the spirit of my invention. Therefore, I do not intend to be limited except by the scope of the following appended claims:

Having described my invention, I claim:

1. A bed comprising,
a spring foundation,
an air mattress supported on said spring foundation, said mattress comprising:
a pair of thin plastic sheets each having a plurality of transversely and longitudinally extending contiguous pockets formed therein,
said pockets being in alignment and sealed on a central plane substantially entirely around their perimeters to form rows and files of cells,
said cells being approximately 7" deep and about 5" in transverse dimension,
the seals between adjacent cells being interrupted to form air passages between cells,
said sheets being transversely sealed at three longitudinally spaced positions to divide said mattress into four zones,
one central zone being about two cells wide to provide waist support,
and means for inflating all of said zones to a pressure between 5 and 22 mmHg with said waist zone being inflated to a substantially greater degree than said other zones, said means maintaining the pressure within the said range whether or not a body is lying on the mattress.

2. The bed of claim 1 further comprising a covering of batting on top of said air mattress.

3. The bed of claim 2 wherein said covering is a quilted nonwoven batting having a stretch of greater than 100%.

4. A mattress comprising,
a pair of plastic sheets overlying each other,
said sheets being formed with a plurality of aligned recesses whose concave surfaces face each other to form a plurality of cells,
said sheets being joined together on a central plane around the perimeter of said sheets,
said sheets being joined together around the perimeter of each said cell except for small gaps which permit cells to communicate with each other,
said cells being grouped into at least three zones which are isolated from each other,
and means for inflating the respective zones to those pressures which will support human bodies, from 100 to 250 pounds in substantial spinal alignment with a straight line,
air pump and valve means for dynamically maintaining said cells at a pressure approximately in the range of 5–22 mmHg, whether or not a body is lying on said mattress.

5. A mattress according to claim 4, said mattress having approximately 20 rows of cells in a longitudinal direction, each row having approximately 8 cells.

6. A mattress according to claim 4 in which each cell is approximately 7" deep.

7. A mattress according to claim 4 in which one of said zones is a waist-supporting zone, the waist-supporting zone is inflated to a greater extent than the remaining zones.

8. A mattress according to claim 7 in which a first zone is for support of the head and trunk and is inflated to about 10 mmHg, a second zone is for support of the waist and is inflated to about 22 mmHg, a third zone is for support of hips and is inflated to about 12 mmHg and a fourth zone is for the legs and is inflated to about 5 mmHg.

9. A mattress according to claim 8 in which said mattress has about 20 rows of cells spaced along the length of said mattress, said zones being approximately the following rows:

| | |
|---|---|
| 1st | rows 1–7 |
| 2nd | rows 8 and 9 |
| 3rd | rows 10–12 |
| 4th | rows 13–20 |

10. A mattress as in claim 4 in which said plastic sheets are approximately 34 mil polyvinylchloride, said gaps between adjacent cells being approximately one-eighth inch wide.

11. A mattress as in claim 4 further comprising a covering providing a quilted nonwoven batting about 1" thick on top of the mattress.

12. A mattress as in claim 4 further comprising,
a pump for each zone,
means for detecting the pressure in each zone,
and means for selectively operating said pumps to maintain said zones at preselected pressures.

13. An air mattress comprising,
a pair of plastic sheets each formed to provide a plurality of recesses having concave surfaces, said sheets being joined together along a central plane with concave surfaces facing to provide a plurality of contiguous bubbles covering substantially the entire mattress area,
each said bubble being at least about 7" deep,
means for inflating said bubbles to between 5 and 22 mmHg, said means keeping said bubbles inflated within the above range regardless of the position of the body lying on the mattress,
said mattress having a transverse section approximately 8–10" wide and engageable by the waist of the sleeper wherein the bubbles are inflated to a substantially greater degree than are the remaining portions of the mattress whereby the waist of the sleeper is held up in spinal alignment with the hips and shoulders of the sleeper.

14. An air mattress comprising,
a pair of thin plastic sheets each having a plurality of contiguous pockets formed therein,
said pockets being in alignment and sealed substantially entirely around their perimeters to form cells,
said cells being approximately 7" deep and about 5" in transverse dimension,
the seals between adjacent cells being interrupted to form air passages between cells,
said sheets being transversely sealed at three longitudinally spaced positions to divide said mattress into four zones,
one central zone being two cells wide to provide waist support,
and means for inflating all of said zones to a pressure between 5 and 22 mmHg with said waist zone being inflated to a substantially greater respect than said other zones, said means maintaining the pressure within the said range whether or not a body is lying on the mattress.

15. An air mattress as in claim 14 further comprising, a pressure sensor associated with each zone, a pump for introducing air into each zone of said mattress, a relief valve connected to each zone, said sensors being connected to said pumps and said relief valves to operate them to keep said zones properly inflated.

16. An air mattress as in claim 15 which said pressure sensors are connected to one side of said mattress and said pumps and relief valves are connected to the other side of said mattress.

17. An air mattress for a bed maintaining substantial spinal alignment while limiting the pressures on a body reclining thereon to substantially subischemic pressure levels, comprising:

a pair of plastic sheets overlying each other and sealed together about their perimeters at about the center plane of the mattress, wherein each of said sheets includes a plurality of longitudinally and transversely aligned recesses extending outwardly from said center line and whose concave surfaces face each other and whose center line portions are sealed substantially entirely about their perimeters with interruptions between adjacent recesses to form rows and files having a plurality of essentially contiguous cells with air passages therebetween in each row and file, wherein said cells have a breadth of not more than about 5 inches and are adapted to provide substantially uniform support for a body reclining thereon at substantially subischemic pressures over at least a substantial breadth of each cell in contact with the body, and wherein said cells have a depth of about 7 inches to prevent a reclining body thereon from bottoming out at subischemic pressures, at least two transverse seals which divide the mattress into at least three zones including an upper torso zone, a waist zone and a leg zone, wherein the rows and files of said cells in each zone are only in communication with each other, and wherein said waist zone is substantially centrally positioned and has a longitudinal dimension sufficient for holding up, at substantially subischemic applied pressures, essentially only the waist of a reclining body, and means for inflating all of said zones at substantially uniform subischemic pressures of about 5 mmHg to about 22 mmHg and maintaining said pressures at subischemic pressures in all of said zones regardless of the position of the reclining body on said air mattress with said waist zone adapted to be inflated and maintained at pressures of at least about twice the pressures of said other zones, whereupon said zones and cells are adapted to continually support a body reclining thereon in substantial spinal alignment and at applied pressures which are substantially subischemic.

* * * * *